US005107764A

United States Patent [19]

Gasparrini

[11] Patent Number: 5,107,764

[45] Date of Patent: Apr. 28, 1992

[54] METHOD AND APPARATUS FOR CARBON DIOXIDE CLEANING OF GRAPHIC ARTS EQUIPMENT

[75] Inventor: Charles R. Gasparrini, Portchester, N.Y.

[73] Assignee: Baldwin Technology Corporation, Stamford, Conn.

[21] Appl. No.: 477,392

[22] Filed: Feb. 13, 1990

[51] Int. Cl.[5] ..... B41F 35/00

[52] U.S. Cl. ..... 101/425; 101/423; 15/318

[58] Field of Search ..... 101/423, 425; 15/318; 134/7

[56] References Cited

U.S. PATENT DOCUMENTS

| | | | |
|---|---|---|---|
| 3,843,409 | 10/1974 | Ice, Jr. | 134/7 |
| 4,038,786 | 8/1977 | Fong | 51/320 |
| 4,344,361 | 8/1982 | MacPhee et al. | 101/425 |
| 4,389,820 | 6/1983 | Fong et al. | 51/410 |
| 4,393,778 | 7/1983 | Kaneko | 101/425 |
| 4,617,064 | 10/1986 | Moore | 51/320 |
| 4,744,181 | 5/1988 | Moore et al. | 51/320 |
| 4,843,770 | 7/1989 | Crane et al. | 51/439 |

FOREIGN PATENT DOCUMENTS

| | | | |
|---|---|---|---|
| 0004948 | 1/1988 | Japan | 101/425 |

*Primary Examiner*—Edgar S. Burr
*Assistant Examiner*—Ren Yan
*Attorney, Agent, or Firm*—Morgan & Finnegan

[57] ABSTRACT

The present invention provides a method and apparatus for cleaning printing press components with carbon dioxide snow or pellets. Upon impact, the snow or pellets dislodge debris adhering to the components and sublime to a non-hazardous gas. A typical component cleaned by the present invention would be a rotating blanket cylinder of an offset printing press. The snow or pellets are typically conveyed by an air stream under pressure to a moving nozzle, a series of fixed nozzles, or some other dispensing device.

21 Claims, 4 Drawing Sheets

METHOD AND APPARATUS FOR CARBON DIOXIDE CLEANING OF GRAPHIC ARTS EQUIPMENT

BACKGROUND OF THE INVENTION

I. Field of the Invention

The present invention relates to a method and device for cleaning equipment in the graphic arts industry by airblasting with solid particles of carbon dioxide. More particularly, the present invention relates to cleaning printing press components by airblasting with particles of carbon dioxide.

II. Discussion of References

Devices employed in the printing industry become contaminated with debris such as ink and lint. This problem occurs whether the printing is on paper or fabrics. The debris also forms, to varying degrees, on all kinds of printing equipment. For example, offset printing has become the predominant printing method in the newspaper publishing industry. Offset printing presses typically employ a blanket cylinder. Blanket cylinder is a rubber cylinder or a rubber-covered cylinder, for the purposes of receiving inked images from a printing plate. The inked images are then offset onto paper paths between the blanket cylinders or an impression cylinder. Continuous printing is made possible by wrapping a printing plate or a plurality of printing plates around the surface of a plate cylinder designed for rotation in contact with the blanket cylinder. In operating blanket-to-blanket presses, a web of paper passes between two blanket cylinders mounted such that one blanket cylinder serves as an impression cylinder for the other. This results in "perfecting" which is simultaneous printing on both sides of the web of paper.

Continuous offset printing is adversely affected by dust and lint from the web of paper which tend to accumulate on the blanket cylinder(s). This dust and lint reduces the quality of the printed product. The accumulation of dust, lint, or ink on a blanket cylinder thus presents a serious annoyance and necessitates undesirable down-time for cleaning. The problem is especially acute in the newspaper industry, when, in response to the rising cost of newsprint stock, less expensive grades of paper having higher lint content often are substituted for more expensive grades.

The problem of collection of debris such as ink, dust and lint on printing devices is not limited to offset printing. It occurs in press equipment in general. For example, it occurs on Anilox Rollers, Flexo Plate Cylinders and Plates, pipe rollers in newspaper presses, metal decorating press blanket cylinders, rollers, and impression cylinders, Gravure press cylinders and rollers, Flexo press cylinders or rollers, and textile printing plates, blankets and rollers. The problem of cleaning printing equipment is well known as indicated by prior efforts for printing equipment cleaner devices.

In some types of printing, sheets are cut and stacked prior to printing. The sheets are prevented from sticking by application of a dusty material such as corn starch. Use of corn starch laden sheets provides another source of debris.

U.S. Pat. No. 4,344,361 to MacPhee et al. discloses an automatic blanket cylinder cleaner having a cleaner fabric adapter to contact a blanket cylinder. A cleaning roll supply roller provides cloth for cloth take-up roll. Positioned between these rolls is a water solvent dispensing tube, a solvent dispensing tube and an inflatable and deflatable mechanical loosening means which is adapted to move the cleaning fabric into and out of the contact with the blanket cylinder. This patent is incorporated by reference.

Devices employing carbon dioxide for sandblasting are disclosed by U.S. Pat. No. 4,038,786 to Fong and U.S. Pat. No. 4,389,820 to Fong et al. Both of these patents are incorporated herein by reference.

However, these patents do not disclose employing particles of carbon dioxide or other sublimable particles for use in cleaning printing devices.

SUMMARY OF THE INVENTION

It is an object of the present invention to provide a method for using carbon dioxide particles to clean debris comprising ink, lint and/or dust from components of printing devices.

It is another object of the present invention to provide an apparatus for cleaning cylindrical components of printing devices with carbon dioxide.

It has been found that components of printing devices, such as a rotating blanket cylinder of an offset printing press, can be cleaned by transporting carbon dioxide particles by use of an air stream under pressure to a nozzle or other dispensing device. The carbon dioxide particles may be in snow or pelletized form. While the pelletized form is preferably shaped as a cylinder, other pelletized forms include spherical forms, tetrahedral forms or other solid chunks of carbon dioxide. The dispensed solid carbon dioxide particles mix with the air stream and discharge from the nozzle to dislodge a build-up of debris from printing device components such as a blanket cylinder. This restores the surface of the component to printable condition.

In the case of a rotating blanket cylinder, this technology provides for cleaning to bare rubber or can be made to allow removing a portion of the debris. This is accomplished by varying the amount, density, and type of particle dispensed along with the length of cycle time and air velocity.

The system includes a storage tank of liquid carbon dioxide and means for converting the liquid carbon dioxide to particles in the form of snow or further converting the liquid carbon dioxide to particles in the form of pellets. The particles are then transported by pressurized air to impinge on the surface to affect cleaning. Upon impact, the pellets dislodge debris and sublime to a non-hazardous gas. Pellets have the best cleaning ability due to size and density.

When a snow system is employed, a pelletizer is unnecessary. In this case, liquid carbon dioxide is converted to snow and transported by pressurized air as in the case of pellets. However, the snow system is simpler than the pellet system because it involves less hardware. In addition to the cleaning method described above, air, vacuum, or mechanical means can be utilized in combination, or alone to remove debris from the cleaned area if desired.

The present invention also pertains to an apparatus for forming the above-described method with debris laden cylindrical components of printing devices. The apparatus includes nozzles either fixedly or movably attached top a bar which is located parallel to the cylindrical component and sufficiently near the cylindrical component such that the carbon dioxide particles discharged from the nozzle will clean the component.

DESCRIPTION OF THE PREFERRED EMBODIMENTS

Figure 1:
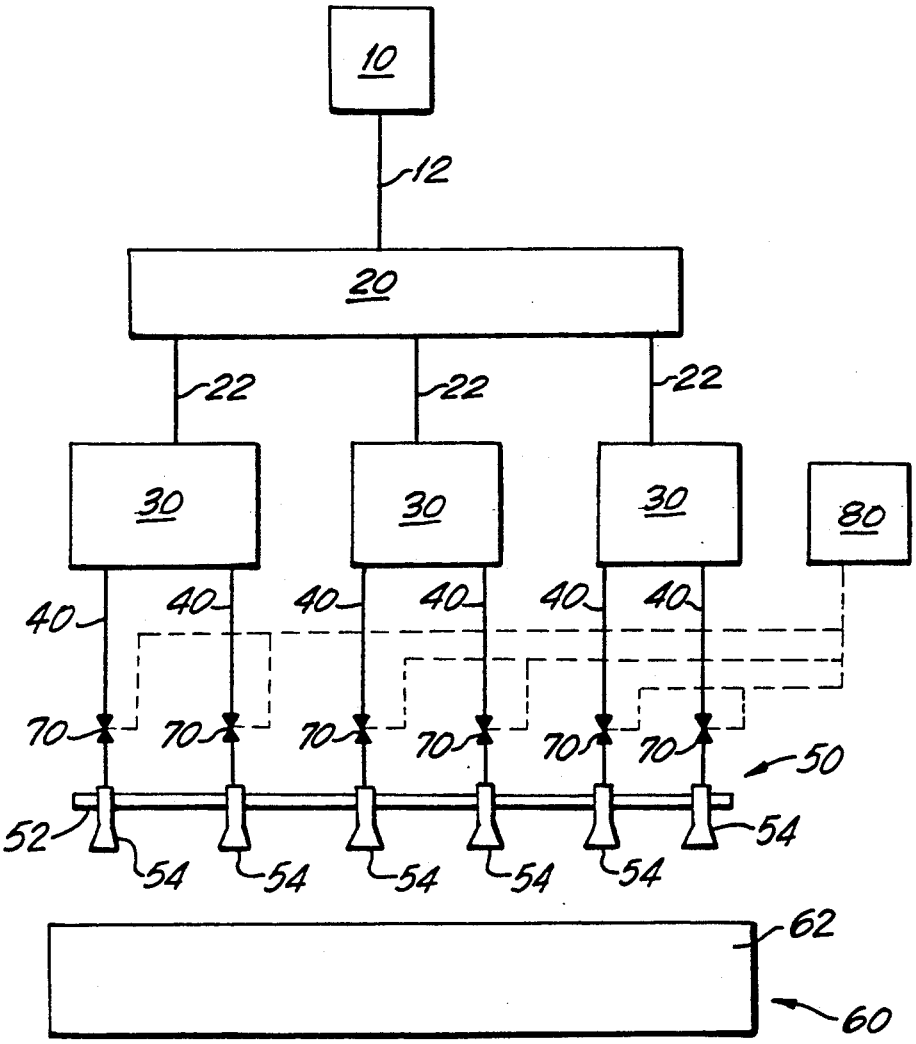
FIG. 1 is a schematic of a first embodiment of an apparatus of the present invention for cleaning a cylindrical component.

FIG. 1 shows a first embodiment of the present invention when employed to clean a roll 60 having a rubber blanket 62. Such a roll 60 is typically employed with offset printing.

The first embodiment includes a carbon dioxide liquid tank 10. A typical carbon dioxide tank 10 has one-ton capacity. The liquid carbon dioxide passes through a conduit 12 to a carbon dioxide solidifier 20. Conduit 12 is preferably no more than 175 feet long. The solidifier 20 includes a snow chamber and, optionally, means for pelletizing the snow. Examples of snow chambers and means for forming pellets from the snow are disclosed by U.S. Pat. Nos. 4,038,786 and 4,389,820; both of which are incorporated herein by reference in their entirety. A typical system pelletizer produces 300 lbs/hr. of pellets. Snow may also be created by an expansion valve and conveyed directly to the nozzles.

The snow or pellets pass through conduits 22 to hoppers 30. Preferably, conduits 22 are each no more than 175 feet long. Hoppers 30 are insulated and preferably provided with a Penberthy-type eductor (not shown) which is air driven. Each hopper is connected to one or two (two shown) nozzles 54 by a conduit 40. Preferably the hoppers are filled prior to when the nozzles discharge.

The nozzles 54 may be a simple conveying type, a venturi nozzle, or a venturi nozzle designed for a supersonic discharge. Preferably the hose/pipe length of the conduit 22 from the pelletizer to the hopper is at most 175 feet. Preferably the hose/pipe length from the conduit from the tank to the snowmaker/pelletizer is at most 175 feet. Nozzle lengths typically range from about 1 to about 4 inches. Preferably each conduit 40 is no more than 20 feet long. The nozzles 54 are part of a press mounted header 50. The press mounted header 50 also includes a bar 52 upon which the nozzles 54 are fixedly mounted. Preferably the header 50 is mounted at any convenient location on the press which locates the nozzles sufficiently close to the blanket 62 to provide cleaning. Typical blankets move 1800 to 2000 feet per minute of paper so it would be advantageous to provide controls to automatically or manually clean the blanket 62 without a person getting dangerously close to the blanket 62 as it rotates. Accordingly, conduits 40 can be provided with valves 70 to control flow rate there through. These valves can either be manually or automatically controlled by an appropriate conventional controller 80.

A typical hopper 30 would hold the amount of pellets which can be conveyed in 30 seconds to 90 seconds. The pellets or snow are conveyed through conduits 22 by conventional pneumatic conveying. The $CO_2$ particles (either snow or pellets) are conveyed from the hoppers 30 to the nozzles 54 through the conduits 40 by pneumatic conveying. One example of such pneumatic conveying is disclosed by U.S. Pat. No. 4,038,786. Typically, compressed air is injected either into the conduit 40 or into the nozzle 54 to accelerate the particles prior to discharge from the nozzle 54. The compressed air typically has a pressure of about 40 to about 200 pounds per square inch gage pressure.

A typical flow rate is 2.4 pounds of pellets per a one inch nozzle. The pellets or snow flow rate ranges from about 0.5 pounds per minute to about 4 pounds per minute per nozzle, typically no more than 3.5 pounds per minute per nozzle, preferably no more than 2.5 pounds per minute per nozzle. Air flow rate ranges from 40 to 60 SCFM for a one inch nozzle. Typically the distance from the hopper to a nozzle is at most 20 feet. Compressed air at a pressure of 40 to 200 psig may be employed to convey particles out of the hopper. Typical pressure ranges from about 30 to about 60 psig. Preferably the pressure ranges from about 40 to about 50 psig. A typical hose/pipe/fitting bend radius ranges from 3 to 4 inches. A typical hose diameter ranges from about $\frac{3}{8}$ to $\frac{3}{4}$ inches. Nozzle diameter may range from one inch to as little as about $\frac{1}{4}$ inch.

Figure 2:
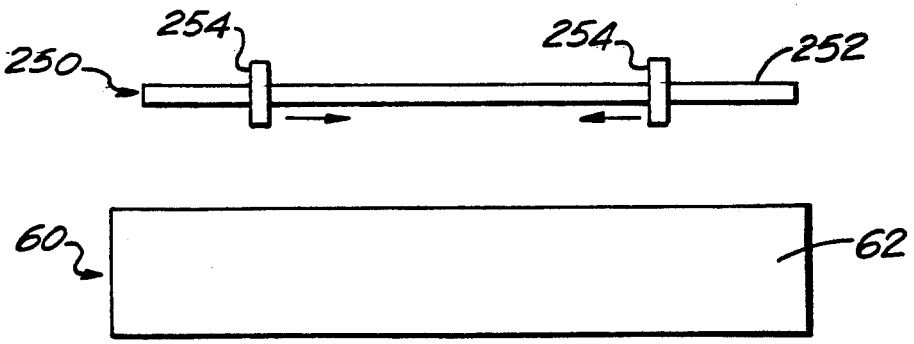
FIG. 2 shows an embodiment of the present invention employing movable nozzles.

The rotating blanket cylinder 62 of an offset printing press can be cleaned by transporting the solid carbon dioxide material by use of an air stream under pressure (either in snow or pelletized form) to the header 50 of fixed nozzles 54 as shown by FIG. 1. FIG. 2 shows a second embodiment of the invention in which the header 50 is replaced by a transport mechanism 250 comprising a bar 252 and movable nozzles 254. Means (not shown) are provided to move the nozzles back and forth along the bar 252 to clean the entirety of the blanket 62. The transport mechanism 250 would be press mounted. At most 10% of the solid carbon dioxide material (either in snow or pelletized form) sublimes prior to discharge from the nozzle 54,254.

Figure 3:
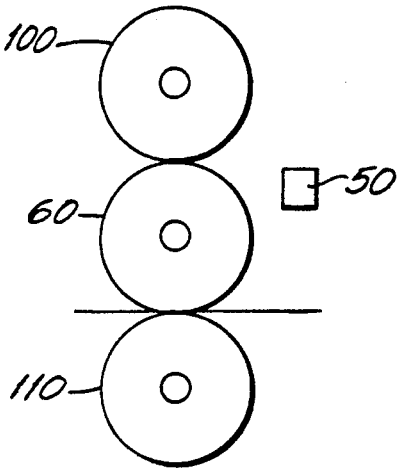
FIG. 3 is a schematic diagram of the present invention employed with an offset printer.

The rotating blanket cylinder 60 of an offset printing press such as shown by FIG. 3, is cleaned by transporting carbon dioxide solid material by use of an air stream under pressure (either in snow or pelletized form) to the moving nozzle 254 or the series of fixed nozzles 54 or other dispensing devices. The dispensed solid, mixed with the air stream, dislodges the debris which includes build-up and piling from the blanket cylinder 60 thereby restoring its surface to printable condition. This technology can provide for cleaning to bare rubber, or can be made to allow removing a portion of the debris. This can be accomplished by the amount and density of the type solid dispensed along with the cycle on-time and air velocity.

The solid particles of carbon dioxide, in either snow or pellet form, are transported by pressurized air to impinge on a surface to affect cleaning. Upon impact, the pellets dislodge the debris and sublime to a non-hazardous gas. Pellets have the best cleaning ability due to size and density, however, a snow system is simpler.

In a case such as the embodiment of FIG. 2 in which two movable nozzles 254 are employed on a single bar 252, two hoppers may be provided per bar to provide one hopper for each nozzle. In another embodiment, one hopper per bar would be employed for two nozzles. In any of the above embodiments, one hopper could be oversized to serve several bars sequenced through valving. The hoppers from the carbon dioxide solidifier 20 should be filled during off time of the cleaning system. The fixed nozzles may be employed in fixed slots and tubes. One carbon dioxide solidifier (with or without pelletizer) would typically be employed per press, although more could be employed as necessary. The snow or pellets would be distributed along a cylinder length varying from 8 inches to 70 inches. The invention may also be employed as a distribution device for cleaning flat surfaces of varying width in one pass.

FIG. 3 shows the rolls of a typical offset printer employing the present invention. Like items bear the same numbers throughout the figures. The offset printer comprises a plate cylinder 100 in contact with the blanket cylinder 60 and an impression cylinder 110. A continuous web of paper 115 would pass between the blanket cylinder 60 and impression cylinder 110. The header 50 would be located sufficiently close to the blanket cylinder 60 such that the carbon dioxide particles would impinge on the blanket cylinder 60 thereby cleaning debris from the blanket cylinder 60. The debris includes ink, as well as lint and dust. Instead of a web 115 of paper, fabric or sheets of paper could pass between the blanket cylinder 60 and impression cylinder 110.

Figure 4:
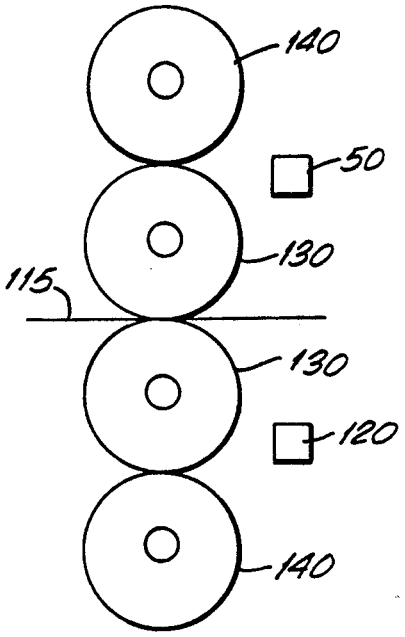
FIG. 4 is a schematic figure of a third embodiment of the present invention employed with a perfecting type offset printer.

Printing on both sides of a web 115 is known as perfecting. Perfecting is accomplished by having an offset printing press as shown in FIG. 4. The offset printing press substitutes the impression cylinder 110 of FIG. 3 with a blanket cylinder 130 in contact with a plate cylinder 140. A second carbon dioxide header 120, which is substantially the same as carbon dioxide header 50, is located sufficiently close to blanket cylinder 130 to clean the blanket cylinder of debris when appropriate.

Figure 5:
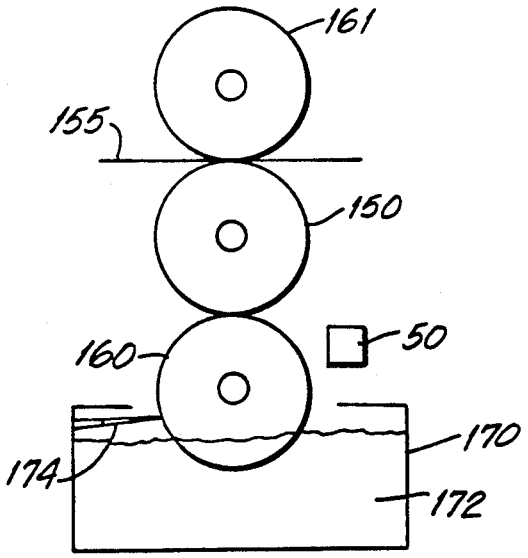
FIG. 5 is a schematic of the present invention employed with an Anilox printer.

FIG. 5 discloses an Anilox printer that is cleaned by the method and apparatus of the present invention. The printer comprises an plate cylinder 150 and an Anilox cylinder 160. The Anilox cylinder 160 is partially immersed in a body of ink 172 located within an ink tank 170. A squeegee 174 is provided to remove excess ink from the Anilox cylinder 160. A web of paper 155 passes between the plate cylinder 150 and impression cylinder 161 as the cylinders rotate. The header 50 is located sufficiently close to the Anilox cylinder 160 so that it may clean the Anilox cylinder 160 with the carbon dioxide particles in snow or pellet form. The Anilox printer shown by FIG. 5 is similar to a Gravure printer so a separate Gravure printer figure is not shown. Header 50 can also be positioned to clean the plate cylinder 150 or impression cylinder 161.

Figure 6:
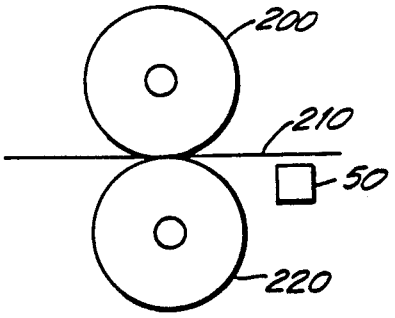
FIG. 6 is a schematic of the present invention employed with a letter press.

FIG. 6 shows a letter press which employs the cleaning method and apparatus of the present invention. This letter press includes a plate cylinder 200 and an impression cylinder 220. A web of paper 210 passes between the cylinders 200, 220 as they rotate. The header 50 of the present invention would be located sufficiently close to the impression cylinder 220 to clean the impression cylinder as appropriate. The letter press shown by FIG. 6 is similar to a Flexo press so a separate Gravure printer figure is not shown. Header 50 can also be positioned to clean plate cylinder 200.

Either the header 50 employing fixed nozzles 54 or the press mounted translation device 250 with movable nozzles 254 may be employed with any of the presses of FIGS. 3-6. Typical designs for nozzles 54, 254 are disclosed by U.S. Pat. Nos. 4,038,786 and 4,389,820.

Either the pellet or snow technique can be employed in the printing industry to clean a wide variety of press and printing equipment in general. Examples of such equipment include the following: blanket cylinders, impression cylinders, Anilox rollers, Flexo plate cylinders and plates, pipe rollers in newspaper presses, metal decorating press blanket cylinders, rollers, and impression cylinders, Gravure press cylinders or rollers, Flexo press cylinders or rollers, and textile printing plates, blankets or rollers, or gripper bar cleaners. Possibilities for cleaning in the graphic arts field are vast and encompass the following areas: lithography (offset), Flexography, Gravure, Intaglio, and letter press. This technology provides substantially hazard-free cleaning.

Figure 7:
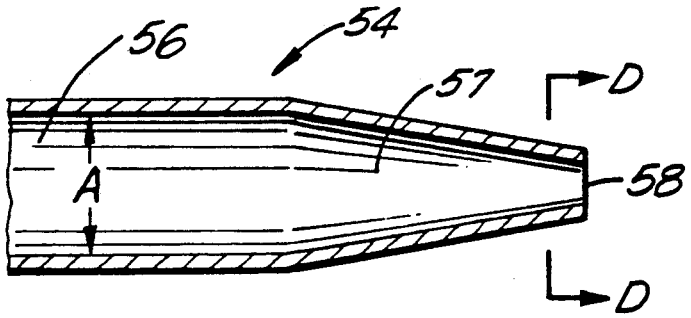
FIG. 7 is an enlarged side view of the downstream end of a nozzle of FIG. 1.
Figure 8:
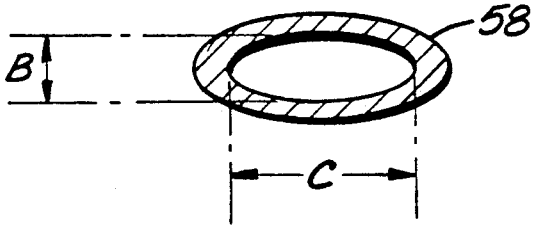
FIG. 8 is a front view of FIG. 7 along section DD.

In the embodiment shown by FIGS. 7 and 8, the nozzle 54 has an upstream cylindrical portion 56 and a downstream tapered neck 57. The neck 57 is tapered in the direction shown on FIG. 7. However, neck 57 is flared in the direction shown in FIG. 1. The downstream tapered portion 57 ends as an elliptical nozzle end 58. In a typical instance, the upstream portion 56 has an inside diameter A of ½ inch and the end 58 is necked down and flared out to have an elliptical shape with a dimension C of about 1 inch and an dimension B sufficient to provide an area equivalent to that of about a ⅜ inch inside diameter circle.

Figure 9:
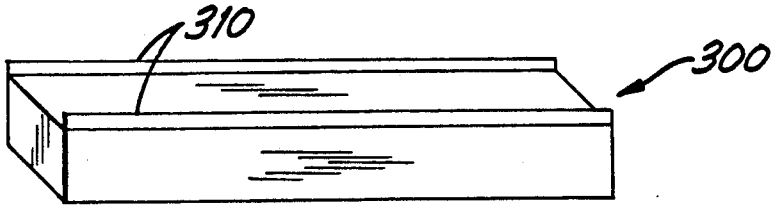
FIG. 9 is an optional nozzle housing.
Figure 10:
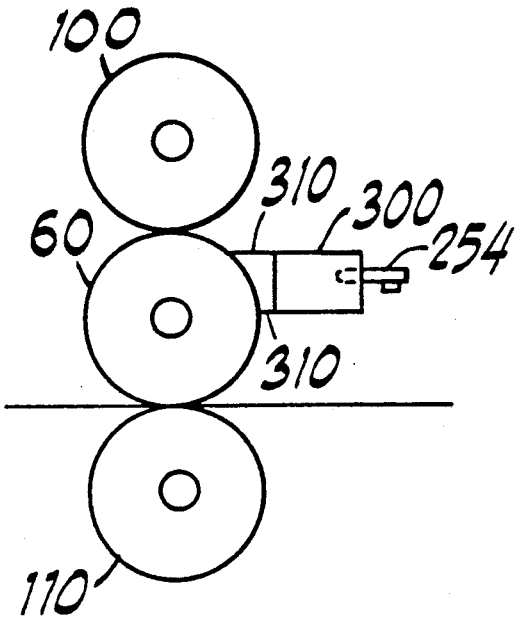
FIG. 10 shows a nozzle partially located within the optional housing.
Figure 11:
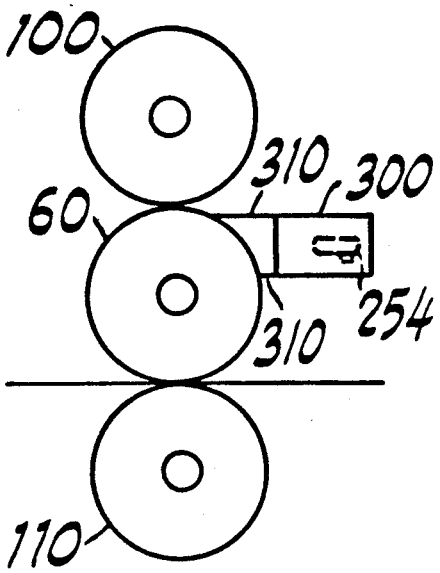
FIG. 11 shows a nozzle entirely located within the optional housing.
Figure 12:
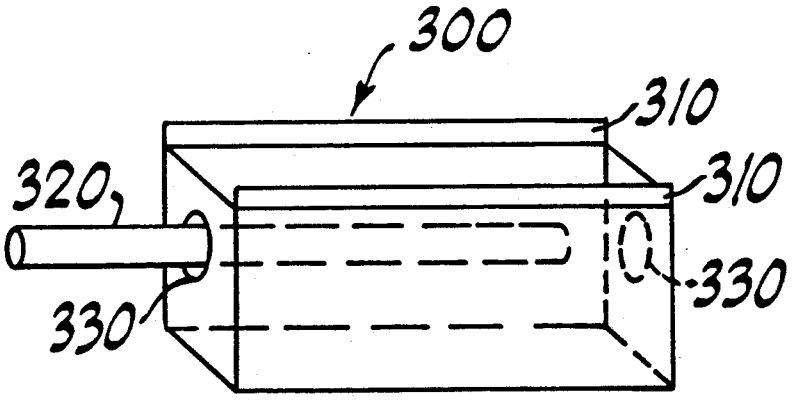
FIG. 12 shows the optional nozzle housing of FIG. 9 provided with a rod like piece to remove debris.

In addition to the cleaning technology described, any or all of air, vacuum or mechanical means may be utilized to remove debris from the cleaned area either before or after cleaning with carbon dioxide. This is accomplished by at least locating nozzle 54 (or 254) or at least its downstream end 57 in a housing 300 shown on FIG. 9. FIG. 10 illustrates the movable nozzle 254 partially located within the housing 300. FIG. 11 illustrates the nozzle 254 within the housing 300. The housing 300 is provided with flexible strips 310 that contact or are adjacent to a cylinder (such as cylinder 60) to form a seal. To clean with vacuum, a vacuum hose, not shown, would be attached to the housing 300 to evacuate it. To clean with air, an air inlet hose (not shown) would be attached to one end of the housing 300 and an air outlet hose (not shown) would be attached to another end of the housing 300. In the case of mechanical cleaning, a rod like piece 320, shown on FIG. 12 for the housing 300 of FIG. 9 would move from one end of the housing 300 to the other end of the housing 300 to push out the removed debris. When employed with the bar 320, the housing 300 would have an opening 330 at each end to allow the bar 320 or debris to pass therethrough. In some cases, especially for cleaning of newspaper related equipment, the debris inconspicuously blends into the newspaper web itself so the housing 300 is unnecessary for some applications.

The present invention is further exemplified by the following non-limiting examples.

EXAMPLE 1

A sheet fed blanket was cleaned of piling by low-pressure pellets. However ink stain remained on the blanket after treatment with low-pressure pellets. The pressure was 40 psig with a flow rate of approximately 40 SCFM.

EXAMPLE 2

A newspaper blanket cleaned completely and quite easily with low-pressure pellets and snow. A nozzle was moved at approximately 6 inches per second at a pellet rate of 2.4 pounds per minute flow. Pressure was 40 psig with a flow rate of approximately 40 SCFM.

Even in Example 1 where the dried ink remained, it is expected that the dried ink could be removed by employing a higher air and pellet flow rate.

It appears that pellet rate could be reduced considerably from the 2.4 pound per minute rate and still clean the blanket of Example 2. The nozzle cleaned the newspaper blanket in one pass. It is expected that a commercial operation would employ one to four washes per hour. Although a one inch nozzle may employ 40 to 60 SCFM, a ⅜ inch nozzle could employ about 8 to about 12 SCFM at 40 psig. A typical blanket cylinder which handles 2000 feet per minute of paper web moves approximately 6 revolutions per second. If a nozzle travels at 6 inches per second, while the cylinder rotates at 6 revolutions per second, then one inch of travel would completely clean the blanket cylinder over the corresponding one inch portion of the blanket.

While specific embodiments of the method and apparatus aspects of the invention have been shown and described, it should be apparent that many modifications can be made thereto without departing from the spirit and scope of the invention. Accordingly, the invention is not limited by the foregoing description, but is only limited by the scope of the claims appended hereto.

I claim:

1. A method for cleaning debris comprising ink and paper lint from a portion of a printing device comprising:

freezing carbon dioxide to form particles comprising carbon dioxide;

conveying said particles with a transport gas through a nozzle;

discharging said particles from said nozzle to contact said portion of said printing device and remove said debris, wherein at most 10% of said formed particles sublime prior to said discharge; and moving said nozzle along a bar which is parallel to said portion of said printing device as said particles discharge from said nozzle.

2. The method of claim 1, wherein said printing device is an offset printing press.

3. The method of claim 2, wherein said portion of said printing press is a blanket cylinder.

4. The method of claim 1, wherein said particles discharge from said nozzle at supersonic speed.

5. The method of claim 4, wherein said portion is selected from a blanket cylinder, an impression cylinder, an Anilox roller, a Flexo plate cylinder, a Flexo plate, a newspaper press pipe roller, a metal decorating press blanket cylinder, a metal decorating press roller, a metal decorating press impression cylinder, a Gravure press cylinder, a Gravure press roller, a Flexo press cylinder, a Flexo press roller, a textile printing plate, a textile printing blanket, a textile printing roller.

6. The method of claim 5, further comprising directing said removed debris away from the vicinity of said portion of said printing device by an air stream.

7. The method of claim 6, wherein said removed debris is vacuumed away from said printing device.

8. The method of claim 5, further comprising collecting said removed debris in a conduit alongside said portion of said printing device and moving a rod like piece from one end of said conduit to another end of said conduit to push the collected debris out of said conduit.

9. The method of claim 5, wherein said particles are in the form of snow.

10. The method of claim 5, wherein said particles are in the form of pellets.

11. The method of claim 5, wherein said particles are conveyed into a hopper, from said hopper through a hose, and then to said nozzle by air at 30–60 psig; 40–60 SCFM of air discharge and about 0.5 to about 3.5 pounds per minute of particles discharge per nozzle; and said nozzle has at least one inside dimension perpendicular to particle flow at its outlet of about 0.375 to about 1.5 inches.

12. The method of claim 11, wherein about 0.5 to about 2.5 pounds per minute of particles discharge per nozzle.

13. The method of claim 8, wherein said conduit is a housing, said housing comprising a means for forming a seal, between said housing and said portion of said printing device, selected from the group consisting of flexible strips that contact said portion of said printing device and flexible strips that are adjacent to said portion of said printing device, said housing being in open communication with said portion of said printing device, said entire nozzle moving and discharging within said housing.

14. The method of claim 1, wherein said particle discharge through two nozzles attached to said bar and said two nozzles move along said bar during said discharging step and each nozzle travels at about 2–12 inches per second.

15. The method of claim 1, wherein said freezing occurs by passing said carbon dioxide through an expansion valve and said particles are conveyed directly to said nozzles.

16. An apparatus for cleaning debris comprising ink and paper link from a cylindrical component of a printing device comprising:

means for generating solid carbon dioxide particles;

a nozzle having an upstream end and a downstream end, said downstream end located to discharge said particles to contact said cylindrical component;

means for conveying said particles from said means for generating to said nozzle;

a translation device attached to said printing device, said translation device comprising a bar, said bar being parallel to said cylindrical component, said nozzle being functionally attached to said bar such that said translation device comprises means for moving said nozzle along said bar during said discharge.

17. The apparatus of claim 16, further comprising a housing, said housing being in open communication with said cylindrical component, said housing comprising means for forming a seal, between said cylindrical component and said housing, selected from the group consisting of flexible strips that contact said portion of said printing press and flexible strips adjacent said portion of said printing press, wherein said nozzle downstream end is located within said housing.

18. The apparatus of claim 17, wherein said housing comprises means for removing debris from said housing after said debris has been cleaned from said cylindrical component.

19. The apparatus of claim 16, wherein said nozzle has a length from about 1 to 4 inches, said nozzle downstream end has an elliptical-opening, and said means for conveying said particles comprises a hopper, a first conduit attached at one end to said means for generating and at another end to said hopper, and a second conduit attached at one end to said hopper and at another end to said nozzle, said first conduit being no more than 175 feet long, said second conduit being no more than 20 feet long.

20. The apparatus of claim 17, wherein said nozzle is entirely located within said housing.

21. An apparatus for cleaning debris comprising ink and paper lint from a cylindrical component of a printing device comprising:

means for generating solid carbon dioxide particles;

a nozzle having an upstream end and a downstream end, said downstream end located to discharge said particles to contact said cylindrical component;

means for conveying said particles from said means for generating to said nozzle;

a bar functionally attached to said printing device, said bar being parallel to said cylindrical component, said nozzle being functionally attached to said bar such that it is movable along said bar during said discharge and directed toward said cylindrical component.

* * * * *